US005722380A

United States Patent [19]

Land et al.

[11] Patent Number: 5,722,380

[45] Date of Patent: Mar. 3, 1998

[54] SPLIT-LIMB COMPOUND ARCHERY BOW

[75] Inventors: Spencer Land, Signal Mtn; Clint Pierce, Dunlap, both of Tenn.

[73] Assignee: High Country Archery, Inc., Dunlap, Tenn.

[21] Appl. No.: 702,789

[22] Filed: Aug. 23, 1996

[51] Int. Cl.[6] ..... F41B 5/10

[52] U.S. Cl. ..... 124/25.6; 124/23.1

[58] Field of Search ..... 124/23.1, 25.6, 124/86, 88

[56] References Cited

U.S. PATENT DOCUMENTS

| | | | |
|---|---|---|---|
| 1,810,335 | 6/1931 | Barnhart | 124/23.1 |
| 4,350,138 | 9/1982 | Caldwell . | |
| 4,644,929 | 2/1987 | Peck | 124/25.6 X |
| 5,231,970 | 8/1993 | Ploot et al. | 124/23.1 |
| 5,339,790 | 8/1994 | Smith | 124/25.6 |
| 5,429,106 | 7/1995 | Martin et al. | 124/23.1 |
| 5,464,001 | 11/1995 | Peck | 124/25.6 |
| 5,487,373 | 1/1996 | Smith | 124/23.1 |
| 5,507,270 | 4/1996 | Smith | 124/23.1 |
| 5,515,836 | 5/1996 | Martin et al. | 124/23.1 |

*Primary Examiner*—John A. Ricci

*Attorney, Agent, or Firm*—Chernoff, Vilhauer, McClung & Stenzel

[57] ABSTRACT

A limb construction for a compound archery bow includes a handle riser and a bow limb attached to the handle riser. The bow limb comprises a pair of independent and separate resilient limb members projecting from the handle riser. The limb members are spaced apart from each other and each have a tip portion opposite the handle riser. A pulley is attached to the bow limb between respective tip portions of the limb members. The handle riser includes a limb mounting bracket. The limb mounting bracket has at least two recesses and at least two mounting pins. Each mounting pin has a projection. The projections are matingly engageable with the recesses, and each mounting pin is also engaged with a respective limb member. The recesses may be cup-shaped and the projections may be dome shaped. A rocking plate is mounted between the projections and the limb members. A shim is between the limb mounting bracket and the bow limb.

10 Claims, 2 Drawing Sheets

SPLIT-LIMB COMPOUND ARCHERY BOW

BACKGROUND OF THE INVENTION

This invention relates to a limb construction in a compound archery bow, and in particular to a bow limb comprising a pair of independent and separate limb members.

Compound archery bows are often used for game hunting and target shooting and in such use the bows may be held for long periods of time for aiming. It is therefore desirable for bows to be light weight for ease of carrying and aiming. It is also desirable to have light weight bow limbs to more efficiently increase the acceleration of the limbs, and thus the arrows, when the drawn bowstring is released. When hunting, it is desirable that the bow limbs not make noise when flexing or unflexing, in order that game not be startled upon the drawing or release of the bowstring.

Traditionally, compound archery bows use a bowstring rigged over pulleys. A pulley is mounted on an axle at the end of each bow limb. The bow limb is forked at its outer end to define a limb crotch to accommodate the pulley. The limb crotch tapers inwardly near the end of the limb and is typically V- or U-shaped. When the bow string is drawn, forces acting on the pulley axle causes the limbs to flex and the pulley to rotate.

A problem with traditional compound bows is the tendency of the bow limbs to crack after repeated flexing. Generally the bow limbs are fabricated of a laminated material which is stronger along the length of the limb than across it. For greatest flexing strength, the interior of the limb is made up of incremental strips which run parallel to the length of the limb from its point of attachment at the handle riser of the bow to the other end of the limb receiving the pulley axle. Adjacent strips are typically held together with adhesives. The limb is covered by reinforcing lamina, such as fiberglass, which has a similar grain structure along the length of the limb. This construction results in a limb which is relatively weak between the strips. The strips at the outer edges of the limb run the entire length of the limb to the pulley axle and directly receive the flexing stress when the bow is drawn. However, strips located in the middle area of the limb terminate somewhere along the limb crotch. These interior strips do not directly receive the limb flexing force and therefore have a tendency to resist flexing as the bow is drawn. Only the interstrip cohesive forces transfer stress to the interior strips from the outer incremental strips in response to the drawing force supplied to the pulley axle. Since the interfiber cohesive forces are not as strong as the strips themselves, the interior strips do not receive as much longitudinal bending stress as the outer strips. As a result the limb has a tendency to bow transversely of its width and to develop significant transverse tensional stresses which concentrate at the area where the crotch is deepest. After repeated flexing, the concentrated transverse tensional stresses eventually tend to overcome the cohesive forces and cause separation of adjacent strips. A crack develops near the end of the crotch.

Limb cracking tends to reduce the useful life of the bow and presents a safety hazard. A cracked limb cannot accommodate stress as readily as an uncracked limb nor can it provide adequate shooting force. Once the limb cracks, the crack rapidly propagates along the limb. A cracked limb may collapse when the bow is drawn and the pulley or broken limb fragments could injure the archer.

Another problem experienced by conventional compound archery bows is the torsional stress exerted on the bow limb by the pulleys. The stress may cause the bow limbs to be pulled out of vertical alignment with the handle riser and each other. If the bow limbs are not properly aligned with each other, the bow will not shoot straight, thus limiting the accuracy of the bow.

Caldwell U.S. Pat. No. 4,350,138 discloses a forked bow limb which is split axially for a substantial portion of the length of the limb. The split divides the limb into two limb portions. The limb portions are held together by means such as a bracket at a point inboard of the crotch so that, when the bow is drawn, the limb portions flex together essentially as though the limb were unsplit along its length. The bracket, however, interferes with the flexing of the limb along its entire length. The bow limb members in Caldwell are not separate and independent and thus remain subject to splitting.

Other prior art methods for preventing the limb from splitting include applying a reinforcing patch to the limb near the bottom of the crotch, installing a bolt or rivet beneath the crotch, and using a harness yoke for the dead-end connection of the bus cables attached to the bow pulleys to achieve uniform stress distribution across the limb. However, none of these methods eliminates the cracking of bow limbs that can occur. In addition, the use of reinforcing bolts or patches increases the weight of the bow limb and reduces the bow limb acceleration.

What is therefore needed is a limb construction for a compound archery bow that is light weight, that does not split when subjected to repeated flexing, that maintains the alignment of the bow limbs for straight shooting of arrows, and that does not produce noise based on the flexing of the bow limbs.

SUMMARY OF THE INVENTION

The present invention overcomes the aforementioned drawbacks of the prior art by providing a novel limb construction for a compound archery bow. In a first aspect of the invention, the limb construction includes a handle riser and a bow limb attached to the handle riser. The bow limb comprises a pair of independent and separate resilient limb members projecting from the handle riser. The limb members are spaced apart from each other and each have a tip portion opposite the handle riser. A pulley is attached to the bow limb between respective tip portions of the limb members. In a preferred embodiment, the limb members are shaped so as to define a V-shaped crotch between the limb members from a point adjacent to the handle riser to the tip portion of each limb member.

This limb construction for a compound bow has several advantages over the prior art. The bow limb is already divided into two separate and independent limb members, and therefore is not subject to splitting. This limb construction also uses less material for a bow limb and results in a lighter limb.

In a second aspect of the invention, the handle riser includes a limb mounting bracket. The limb mounting bracket has at least two recesses and at least two mounting pins. Each mounting pin has a projection. The projections are matingly engageable with the recesses, and each mounting pin is also engaged with a respective limb member. The recesses may be cup-shaped and the projections may be dome shaped. A preferred embodiment includes a rocking plate mounted between the projections and the limb members.

This second aspect of the invention has the advantage that it maintains the longitudinal alignment of the bow limb during flexing of the limb. It also has the advantage of allowing each bow limb member to flex smoothly relative to the limb mounting bracket as the bowstring is drawn and released.

A third aspect of the invention includes a limb mounting bracket attached to the handle riser and a shim between the limb mounting bracket and the bow limb. The shim maintains the alignment of the bow limb for increased accuracy of shooting. In addition, the shim reduces noise and vibration associated with the flexing of the bow limb.

The present invention is also suitable for use in a compound archery bow including a handle riser and two bow limbs attached to the handle riser. Two bow limbs project oppositely from the handle riser. A pulley is attached to each of the bow limbs between respective tip portions of each of the bow limbs. A bowstring and cable assembly is strung between the pulleys. The first, second and third aspects of the invention may be readily incorporated into such a compound archery bow.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
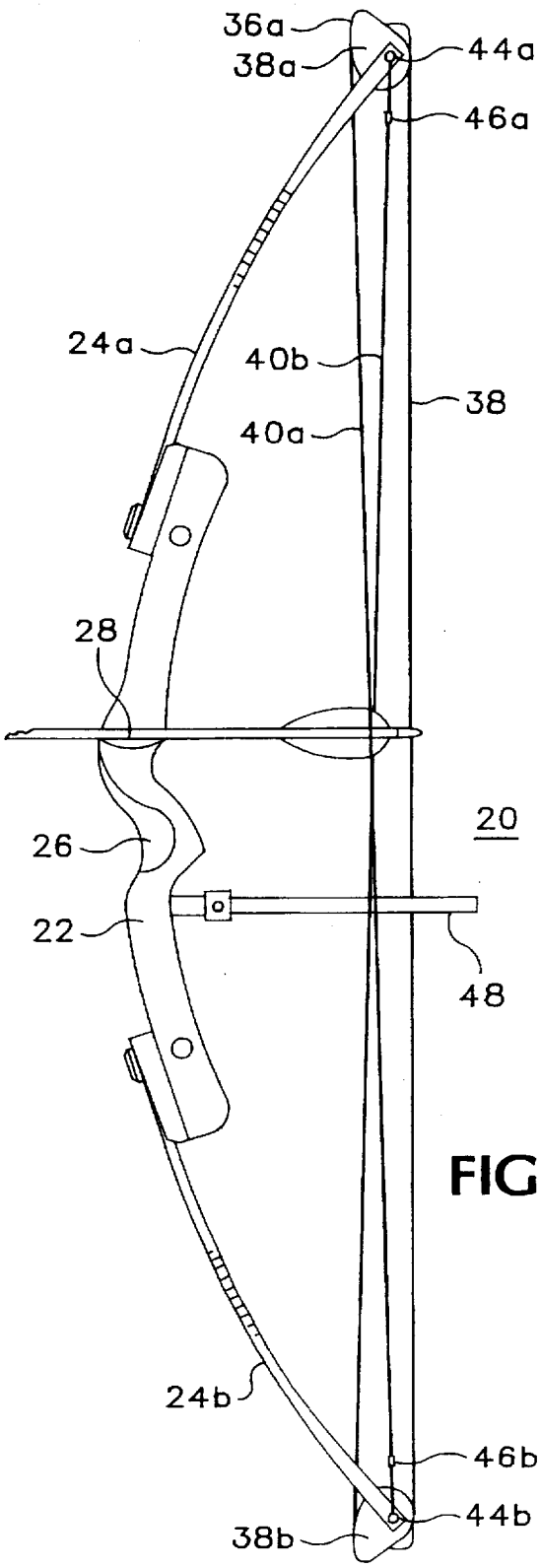
FIG. 1 shows a side view of a preferred embodiment of the compound archery bow of the present invention.
Figure 2:
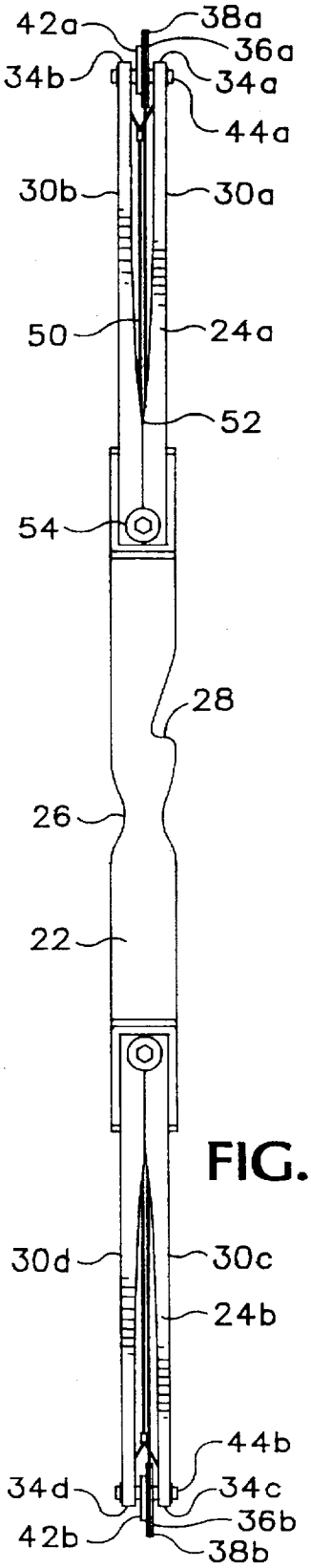
FIG. 2 shows a front view of a preferred embodiment of the compound archery bow of the present invention.

FIG. 1 shows a compound archery bow 20. The bow 20 has a handle riser 22 on which two bow limbs 24*a*, 24*b* are mounted. The handle riser 22 is made of cast aluminum. The handle riser 22 includes a hand grip 26 and an arrow shelf 28.

Each of bow limbs 24*a* and 24*b* is comprised of a pair of independent and separate resilient bow limb members 30*a*, 30*b* and 30*c*, 30*d*, respectively, projecting from the handle riser 22. The bow limb members 30*a*, 30*b* and 30*c*, 30*d* are spaced apart from each other and each has a respective tip portion 34*a*, 34*b*, 34*c*, 34*d* opposite the handle riser 22. The bow limb members 30*a*, 30*b*, 30*c* and 30*d* are made from resilient strips which run parallel to the length of the bow limb from its point of attachment at the handle riser 22 to the respective tip portion 34*a*, 34*b*, 34*c* or 34*d* of each bow limb member. Each bow limb 24*a*, 24*b* is covered by a reinforcing laminate such as fiberglass. Because the limb members are independent and separate from each other, the bow limb is not subject to cracking at the crotch. This bow limb construction also uses less material and thus results in a lighter bow.

Composite cam pulleys 36*a*, 36*b* are mounted on the tip portions 34*a*, 34*b* and 34*c*, 34*d* of the respective bow limbs 24*a*, 24*b*. A bowstring 38 connects the cam pulleys 36*a* and 36*b*, engaging the bow string cam pulley sections 38*a*, 38*b* of the composite pulleys 36*a*, 36*b*. Take-up strings 40*a*, 40*b* engage the take-up string cam pulley sections 42*a*, 42*b* of the composite pulleys. Take-up string 40*a* extends between the take-up string cam pulley section 42*a* on the tip portion of bow limb 24*a* and axle 44*b* on the opposite bow limb 24*b*. Likewise, take-up string 40*b* extends between take-up string cam pulley section 42*b* and axle 44*a*. Each take-up string 40*a*, 40*b* has a respective harness yoke 46*a* or 46*b* for connection to its respective axle. The pulleys mounted on the bow limb tip portions 34*a*, 34*b* and 34*c*, 34*d* may be of the type generally shown in the compound bows in Allen U.S. Pat. No. 3,486,495, Kudlacek U.S. Pat. No. 4,060,066, Barna U.S. Pat. No. 4,202,316 and Jennings U.S. Pat. No. 4,241,715.

A guard rod 48 extends from the handle riser 22 toward and into overlapping relationship with the take-up strings 40*a*, 40*b* and the bow string 38 when the bow string 38 is in its straight condition so as to hold the take-up strings 40*a*, 40*b* laterally out of the path of movement of the arrow during shooting.

Figure 3:
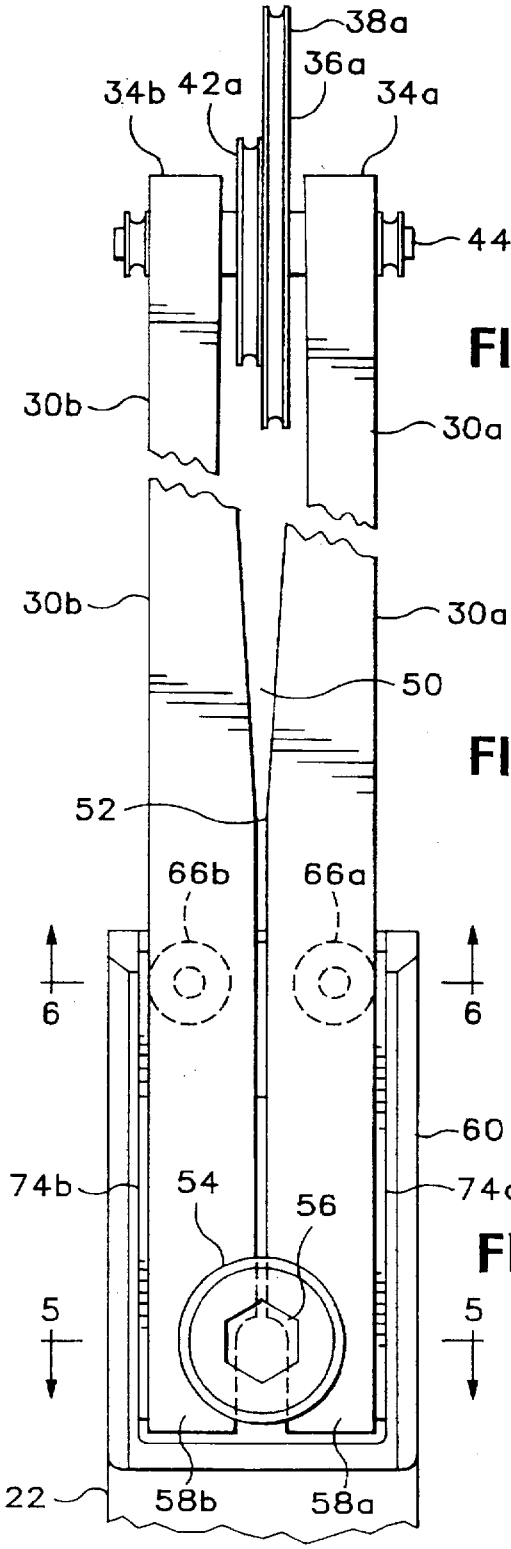
FIG. 3 is a front view of a preferred embodiment of a limb construction of the present invention.
Figure 6:
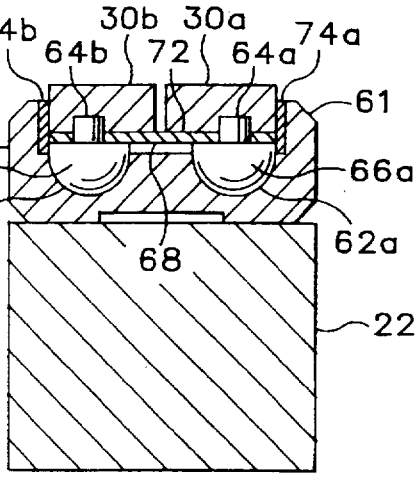
FIG. 6 is a view along the line 6—6 of FIG. 3.
Figure 5:
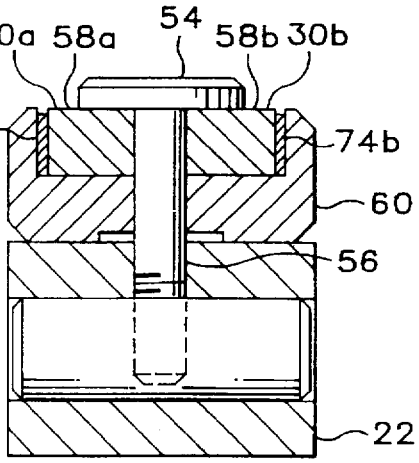
FIG. 5 is a view along the line 5—5 of FIG. 3.
Figure 4:
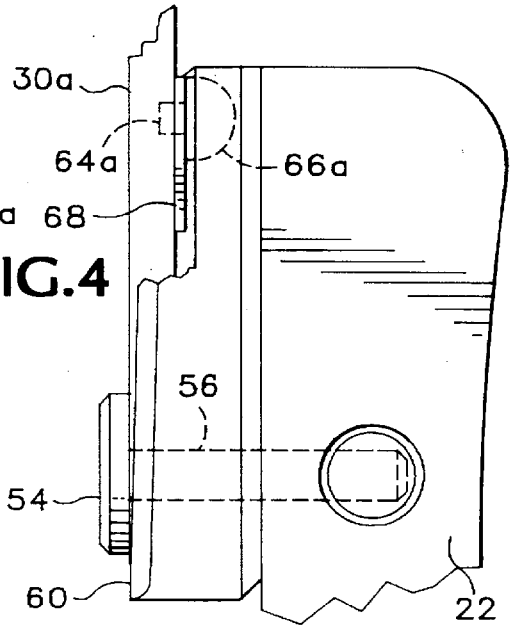
FIG. 4 is a partial side sectional view of a preferred embodiment of the limb construction of the present invention.

FIG. 3 shows the limb construction of the compound archery bow 20 in an unstrung, and therefore unflexed, condition. The limb members 30*a*, 30*b* are shaped so as to define a V-shaped crotch 50 between the limb members 30*a*, 30*b* from a point 52 adjacent to the handle riser to the tip portion 34*a*, 34*b* of each limb member 30*a*, 30*b*. Each of the limb members 30*a*, 30*b* has a longitudinal axis. Each limb member tapers in width along a substantial portion of the longitudinal axis, the width being narrower near the tip portions 34*a*, 34*b* and wider adjacent the handle riser 22 and point 52. This construction minimizes the risk of splitting of the bow limbs. The long taper results in greater overlap among the resilient, laminated strips, and therefore results in less failure of the limb members.

The limb members are attached to the handle riser by a button 54 that is insertable between the limb members 30*a*, 30*b*. A threaded bolt 56 attaches the button to the handle riser 22. The button 54 frictionally engages the top surface 58*a*, 58*b* of each of the limb members 30*a*, 30*b* to hold the limb members against the handle riser 22. By tightening or loosening the bolt 56 the shooting weight of the compound archery bow 20 may be adjusted.

The handle riser has an integral aluminum limb mounting bracket 60. The limb mounting bracket has side walls 61 and a void through which the bolt 56 is inserted so that the bolt 56 may be connected to the handle riser. The limb mounting bracket 60 has at least two recesses 62*a*, 62*b* which are cup-shaped. Two mounting pins 64*a*, 64*b* rest above the recesses 62*a*, 62*b*. Each respective mounting pin 64*a*, 64*b* has a dome-shaped projection 66*a*, 66*b* which is matingly engageable with the recesses 62*a*, 62*b*. Each mounting pin 64*a*, 64*b* engages a respective limb member 30*a*, 30*b*. The dome-shaped projections 66*a*, 66*b* of the mounting pins 64*a*, 64*b* fit in the cup-shaped recesses 62*a*, 62*b* and allow the limb members 30*a*, 30*b* to rock smoothly with respect to the handle riser 22 when flexing after the bowstring has been released. The projections 66*a*, 66*b* engaged with the recesses 62*a*, 62*b* also maintain the alignment of the limb members 30*a*, 30*b* thus allowing the limb construction to provide greater accuracy when shooting.

A rocking plate 68 is mounted between the projections 66*a*, 66*b* in the limb members 30*a*, 30*b*. The rocking plate 68 has at least two voids so that each mounting pin 64*a*, 64*b* extends through a void to mate with a respective limb member 30*a*, 30*b*. The rocking plate 68 thus provides a flat surface 72 against which each limb member 30*a*, 30*b* rests.

The rocking plate 68 assists both limb members 30*a*, 30*b* to unflex in unison after the bowstring has been released, and therefore aides in the accuracy of shooting. Nevertheless, the rocking plate 68 does not interfere with the subsequent independent movement of each limb member 30*a*, 30*b*.

Shims 74*a*, 74*b* are placed between the limb members 30*a*, 30*b* and the side walls 61 of limb mounting bracket 60. In compound archery bow 20 the shims 74*a*, 74*b* are made of rubber. The rubber shims further help maintain the alignment of the limb members. In addition, the shims eliminate noise and vibration associated with releasing the bowstring. While the shims 74*a*, 74*b* are made of rubber, other resilient materials could be used to dampen vibration and eliminate noise.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A compound archery bow comprising:

(a) a handle-riser;

(b) two bow limbs attached to said handle riser, said bow limbs projecting oppositely from said handle riser, each of said bow limbs comprising a pair of separate and independent resilient limb members projecting from said handle riser, said limb members being spaced apart from each other and each limb member having a tip portion opposite said handle riser;

(c) a pulley attached to each of said bow limbs between respective tip portions of each of said bow limbs;

(d) a bowstring and cable assembly strung between said pulleys;

(e) two limb mounting brackets, each of said limb mounting brackets attached to said handle riser and associated with a respective bow limb, each of said limb mounting brackets having at least two recesses and at least two mounting pins, each mounting pin having a projection, said projections matingly engageable with said recesses, and each mounting pin engaged with a respective bow limb member; and (f) a rocking plate, said rocking plate mounted between said projections and said limb members.

2. The compound archery bow of claim 1 wherein said limb members are shaped so as to define a V-shaped crotch between said limb members from a point adjacent said handle riser to said tip portion of each limb member.

3. The compound archery bow of claim 1 wherein said limb members are attached to said handle riser by a button insertable between said limb members, said button frictionally engaging a top surface of each of said limb members whereby to hold said limb members in engagement with said handle riser.

4. The compound archery bow of claim 1 wherein each of said limb members has a longitudinal axis, and each of said limb members tapers in width along a substantial portion of said longitudinal axis, said width being narrower near said tip portion and wider adjacent said riser.

5. The compound archery bow of claim 1 including two limb mounting brackets, each attached to said handle riser and each associated with a respective bow limb, and a shim between each of said limb mounting brackets and said respective bow limb.

6. The compound archery bow of claim 1 wherein said recesses are cup-shaped and said projections are dome-shaped.

7. A compound archery bow comprising:

(a) a handle-riser;

(b) two bow limbs attached to said handle riser, said bow limbs projecting oppositely from said handle riser, each of said bow limbs comprising a pair of separate and independent resilient limb members projecting from said handle riser, said limb members being spaced apart from each other along their entire length, each of said limb members engaging a rocking plate situated between said limb member and said handle riser, and each limb member having a tip portion opposite said handle riser;

(c) a pulley attached to each of said bow limbs between respective tip portions of each of said bow limbs; and (d) a bowstring and cable assembly strung between said pulleys.

8. The compound archery bow of claim 7 wherein said limb members are shaped so as to define a V-shaped crotch between said limb members from a point adjacent said handle riser to said tip portion of each limb member.

9. The compound archery bow of claim 7 wherein each of said limb members has a longitudinal axis, and each of said limb members tapers in width along a substantial portion of said longitudinal axis, said width being narrower near said tip portion and wider adjacent said riser.

10. The compound archery bow of claim 7 including two limb mounting brackets, each attached to said handle riser and each associated with a respective bow limb, and a shim between each of said limb mounting brackets and said respective bow limb.

* * * * *